US006948468B1

(12) United States Patent
Decuir, Jr.

(10) Patent No.: US 6,948,468 B1
(45) Date of Patent: Sep. 27, 2005

(54) DESMODROMIC VALVE AND ADJUSTABLE CAM SYSTEM

(75) Inventor: Julian A. Decuir, Jr., Pinon Hills, CA (US)

(73) Assignee: Decuir Engine Technologies, LLC

( * ) Notice: Subject to any disclaimer, the term of this patent is extended or adjusted under 35 U.S.C. 154(b) by 0 days.

(21) Appl. No.: 10/838,107

(22) Filed: May 3, 2004

(51) Int. Cl.[7] ..... F01L 1/30
(52) U.S. Cl. ..... 123/90.24; 123/90.16; 123/90.27
(58) Field of Search ..... 123/90.24, 90.16, 123/90.26, 90.27

(56) References Cited

U.S. PATENT DOCUMENTS

| | | | | |
|---|---|---|---|---|
| 1,644,059 | A | 10/1927 | Holle | |
| 4,711,202 | A | 12/1987 | Baker | |
| 2004/0094108 | A1 * | 5/2004 | Battlogg | 123/90.26 |

OTHER PUBLICATIONS

Website printout dated Feb. 11, 2004; 2 pages; Classification; http://members1.chello.nl/~wgj.jansen/text/classification.html.

Website printout dated Feb. 11, 2004; 8 pages; One Hundred Years of Desmo-Patenting; http://members1.chello.nl/~wgj.jansen/text/honderdjaar.html.

* cited by examiner

*Primary Examiner*—Thomas Denion
*Assistant Examiner*—Zelalem Eshete
(74) *Attorney, Agent, or Firm*—Stetina Brunda Garred & Brucker

(57) ABSTRACT

The present invention provides an exemplary rockerless desmodromic valve and adjustable overhead cam system adapted to be installed onto a head for an internal combustion engine which utilizes at least one valve for each intake and exhaust port. The system includes a plurality of valves having a retaining sphere disposed on a distal tip of a stem of each valve; a camshaft; and a split cam lobe assembly assigned to each valve. The split cam lobe assemblies include a left and right cam lobe, a camshaft receiving hole oriented transversely through each cam lobe adapted to slidably receive the camshaft, and a cam following groove halve disposed on the interior side. Furthermore, the interior sides of the left and right cam lobe are adapted to be interfaced together to form a following groove having a generally spherical cross-sectional shape adapted to slidably receive the retaining sphere from a respective one of the valves. The system further includes a plurality of springs concentrically disposed around the camshaft and further longitudinally positioned between cam lobe assemblies and the bearing journals, wherein the plurality of springs maintain a constant force against the exterior sides of the cam lobes to maintain the split lobe cam assemblies compressed together.

23 Claims, 15 Drawing Sheets

33
0°
90°
180°
270°

99
94
60'
60''
60'''

DESMODROMIC VALVE AND ADJUSTABLE CAM SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates to desmodromic valve and cam systems for internal combustion engines with poppet valves. In particular, the present invention relates to a rockerless desmodromic valve and adjustable cam system which utilizes splitting cam lobe assemblies with internal follower grooves. The present invention also relates to camshafts which have replaceable cam lobes providing various duration/timing adjustability options.

2. Background of the Invention

Most conventional internal combustion piston driven engines utilize valve trains to induct an air/fuel mixture into the cylinders and to expel the burned air/fuel mixture from the cylinders. Typically, each cylinder is assigned at least one poppet intake valve and at least one exhaust poppet valve. The valves are driven open by cam lobes on a camshaft that push against the valves to open the valves as the camshaft rotates. In a different manner, the valves are forced closed by springs concentrically disposed around the stems of the valves.

For example, in a typical four-stroke engine, an intake valve is opened by the force of a cam lobe while the piston goes down inducting an air/fuel mixture into the cylinder (I.E., induction stroke). Next, the intake valve closes by force of a spring while the piston moves upward. This compresses the air/fuel mixture (I.E., compression stroke). With all the valves closed so that the combustion chamber is sealed tight, a spark is then produced by a spark plug which ignites the air/fuel mixture wherein the rapidly expanding hot gases force the piston downward with great energy creating power (I.E., power stroke). The exhaust valve then opens by force of a cam lobe and as the piston moves back up it expels the burned air/fuel mixture (I.E., exhaust stroke).

For the conventional combustion engine with poppet valves to run efficiently, the valves must open and close with great precision. Their ability to tightly seal when closed must be nearly perfect. This timing aspect is controlled by the cam, which either directly, or through a rocker mechanism, pushes the valve open at the correct time. This manner in opening the valves has proven to be highly effective.

However, closing the valve by the force of the spring has its disadvantages. Most notably, the use of springs to close the valves utilizes/consumes engine power. The springs in an engine induce excessive tension into the valve train because they continuously force the valve mechanism against the cam lobes as the camshaft rotates. Another disadvantage is that because the cam mechanism cannot afford to have any 'bounce' from the springs, the cam profile has to be somewhat gentle, I.E., it must gently push the valve, but never shove it. This means the valve must open slowly like a water faucet—not quickly like a light switch, for example. Another disadvantage is that when the motor is turned at high RPM's, the valves can "float" and hit the piston. Valve float happens when the speed of the engine is too great for the valve springs to handle. As a result, the valves will stay open and/or "bounce" on their seats.

To overcome these disadvantages, innovative desmodromic valve trains have evolved over about the last century; however, in a very slow technological pace and in most applications with little or limited success. The term "desmodromic" arises from the two Greek words: "desmos" (controlled or linked), and "dromos" (course or track). A desmodromic system is also known as system that provides "positive valve actuation" wherein both strokes are "controlled". In other words, desmodromic valves are those which are positively closed by a leverage system or follower, rather than relying on the more conventional springs to close the valves. Typically, a desmodromic valve operating system utilizes a camshaft that controls both the opening and closing of the valve.

Desmodromic valve trains have several advantages over conventional spring closed valves trains. A first major advantage is that in a desmodromic valve system there is almost no wasted energy in driving the valve train. In other words, the constant force that the springs exert on the lobes of the camshaft is removed. Another advantage is that because there is no tension and no possibility of "bounce" in the desmodromic system, the cam profiles can be as steep as the engine designer wishes them to be. This desirable aspect allows the engine to be more powerful and more flexible. Thus, the manufacturer can use more radical cam grinds or profiles for better performance. Another advantage is that when the motor is turned at high RPM's or even over-revved, the valves are still controlled, whereas when the valves are returned by springs the valves "float" and hit the piston.

Nevertheless, even though desmodromic valve trains have the aforementioned advantages, they have had limited success in large scale commercial applications due to reliability issues, complexity of design, and valve train binding to name a few reasons. The most relevant prior art is now herein discussed below.

U.S. Pat. No. 4,711,202 to Baker [hereinafter "BAKER"] teaches a direct acting cam-valve assembly. BAKER discloses a double cam designated 60 fixed to an engine driven camshaft 26. The double cam forms a following track composed of internal or inner cam 64 and 63a, and an internal or outer cam 64 and 64a. The valve stem 11a is connected to a cam follower 30 which has a pair of roller followers 56 transversely disposed on the top distal tip of the cam follower 30. The followers are retained within the following track. During engine operation, as the camshaft 26 is rotated, the roller followers 56 engaging the inner cams 63, 63a will operate to effect opening movement of the poppet valve 11 from the closed position to the open position via a hydraulic lash adjuster 40. However, upon continued rotation of the camshaft 26, the roller follower 56 engaging the outer cams 64, 64a will pull the cam follower 30 back up and, via the force of spring 70 it will also move the poppet valve toward the closed position.

Although the BAKER reference discloses a highly refined desmodromic solution, it does have some disadvantages. The main disadvantage of the BAKER desmodromic system is its complexity. The head requires at least a cavity 16, guide bore 15 an oil galleries 50, 53, standing pads 18, and longitudinal extending bores 24. All of these aforementioned features add significant machining costs to the manufacture of the head. Thus, additional complexity to the head greatly adds costs to the entire BAKER desmodromic system. Additionally, the spring 70 still induces some tension into the valve train.

U.S. Pat. No. 1,644,059 to Holle [hereinafter HOLLE] discloses a desmodromic type valve actuating mechanism in FIGS. 4–6 in which an internal cam 29 and external cam 31 are attached to shaft 1a. A roller mechanism 26–28 attached to a connecting rod 25 which is further connected to linking yoke which in turn is attached to the valve stem 14. A spring 24 is concentrically disposed around the valve stem in a compressed manner. The spring 24 acts to hold the valve fully closed or seated. However, the drawback of HOLLE is that it provides no solution on how the system may be integrated into a modern heavy duty cast head. Additionally, the spring 24 still induces some tension into the valve train.

It would be advantageous to provide a desmodromic valve and cam system which does not depend on springs to return the valve head closed to fully eliminate any binding tension that the springs typically induce into the valve train system. Moreover, it would be advantageous to provide a desmodromic valve and cam system which is simple to manufacture and of which utilizes few parts. An ideal desmodromic valve and cam system could either be integrated into modern engines having specially designed heads, or retrofit onto existing heads that are already on internal combustion engines. Furthermore, it would be desirable to provide a desmodromic valve and cam system which would have interchangeable cams. With such a feature, various cams having varying profiles, durations, etc. could be utilized on the same system. Moreover, it would even be more desirable to provide cams of which the timing could be either individually advanced or retarded by merely choosing the position on which the cam lobe is installed onto the camshaft. Such features would provide a wide array of adjustability in regards to being able to tune the engines performance characteristics.

BRIEF SUMMARY OF THE INVENTION

In general, the present invention provides a desmodromic valve and cam system does not utilize springs to close the valve head to fully eliminate binding tension that the springs induce into the valve train system. The system is simple to manufacture and utilizes few parts. The present invention may be integrated into modern engines with having specially designed heads, or retrofit onto existing heads that are already on internal combustion engines. Furthermore, the desmodromic valve and cam system has interchangeable and replaceable cams. With such a feature, cams having varying profiles, durations, etc. may be utilized on the same system. Moreover, the present invention provides cams of which the timing can be either advanced or retarded by merely choosing the position of which the cam is installed onto the camshaft. Such features provide a wide array of adjustability in regards to being able to tune the engines performance characteristics.

More specifically, the present invention provides an exemplary rockerless desmodromic valve and adjustable overhead cam system adapted to be installed onto a head for an internal combustion engine which utilizes at least one poppet valve for each intake and exhaust port. The system includes a plurality of valves having a retaining sphere disposed on a distal tip of a stem of each valve; a camshaft adapted to be transversely positioned within a plurality of bearing journals transversely positioned and spaced along a longitudinal length of the head; and a split cam lobe assembly assigned to each valve. The split cam lobe assemblies include a left cam lobe having an exterior side, interior side, a camshaft receiving hole oriented transversely through said left cam lobe adapted to slidably receive the camshaft, and a leftside cam following groove halve disposed on the interior side; and a right cam lobe having an exterior side, interior side, a camshaft receiving hole oriented transversely through the right cam lobe adapted to slidably receive the camshaft, and a rightside cam following groove halve disposed on the interior side. Furthermore, the interior sides of the left and right cam lobe are adapted to be interfaced together to form a following groove having a generally spherical cross-sectional shape adapted to slidably receive and retain the retaining sphere from a respective one of the valves.

According to the present invention, the desmodromic valve and adjustable overhead cam system further comprises a plurality of springs concentrically disposed around the camshaft and further longitudinally positioned between cam lobe assemblies and the bearing journals, wherein the plurality of springs maintain a constant force against the exterior sides of the cam lobes to maintain the split lobe cam assemblies compressed together.

According to an aspect of the present invention, when a head of a valve is overforced into a valve seat, a respective cam lobe assembly connected to a respective retaining sphere on a respective valve, slightly splits open to provide a slidable fitting having a relaxed tolerance between the following groove and the respective retaining sphere to minimize valve train binding. According to another aspect of the present invention, when the head of the valve is lowered from the valve seat, the respective cam lobe assembly connected to the respective retaining sphere on the respective valve is forced back into an unsplit mode by springs.

According to another aspect of the present invention, the camshaft further comprises a plurality of bearing surfaces on an exterior surface of the camshaft adapted to be received by the bearing journals, and a plurality of sections of splines disposed on the exterior surface of the camshaft for slidably receiving the cam lobe assemblies. The camshaft further comprises a retaining head disposed on one distal end of the camshaft, and a cam drive stem disposed on another distal end of the camshaft for receiving a cam drive.

And yet another embodiment of the present invention includes a camshaft comprising camshaft segments, each camshaft segment adapted to be longitudinally attached together to form an assembled camshaft. Additionally, another aspect of the present invention includes a cam drive attached to the cam drive stem.

Another aspect of the present invention includes each of the plurality of valves comprising a sphere receiving shaft formed on the distal tip of the stem of each valve, wherein a threaded hole is disposed within the sphere receiving shaft, the threaded hole adapted to receive a threaded fastener to secure the retaining sphere to a respective valve stem. According to yet another aspect of the present invention, the retaining sphere comprises a spherical body having a shaft hole disposed through the spherical body, wherein the shaft hole is adapted to receive a sphere receiving shaft formed on the distal tip of the stem of said valve.

Moreover, an aspect of the present invention may include a camshaft bearing support bracketing system which provides the bearing journals. The camshaft bearing support bracketing system may include a bottom portion adapted to be mounted to a top surface of the head, and an upright portion integrally formed with the bottom portion; and a plurality of journal bearing brackets attached in a normal and vertically upright orientation to an inside surface of the upright portion. Each of the plurality of journal brackets may further comprise a lower journal interface surface having a lower bearing journal transversely formed through the lower journal interface, and a journal cap adapted to be interfaced to the lower journal interface. The journal cap includes an upper journal interface surface having an upper bearing journal transversely formed through the upper journal interface surface, wherein a cylindrical bearing interface is formed when the journal cap is attached to a respective one the plurality of journal brackets. According to another aspect of the present invention, a pair of semicircular bearing inserts may be installed into said upper and lower bearing journal interface.

According to another aspect of the present invention, the left and right cam lobes further comprise a hub integrally formed to the interior side of the cam lobe, wherein the hub from the left and right cam lobes are adapted to be compressed together by said springs. According to another aspect of the present invention, the left and right cam lobes each include a splined camshaft receiving hole adapted to be received by the splined sections of the camshaft.

According to another aspect of the present invention, the right and left cam lobes have a cam lobe center axis transversely oriented through a center of the cam lobe. According to another aspect of the present invention, the right and left cam lobes include a camshaft receiving hole centered about a camshaft center axis in which the camshaft center axis is radially offset from the cam lobe center axis. According to another aspect of the present invention, the leftside and rightside cam following groove halves are concentrically centered about the cam lobe center axis.

According to an alternative embodiment of the present invention, the right and left cam lobes include a camshaft receiving hole centered about a camshaft center axis, wherein the camshaft center axis is coincident with the cam lobe center axis, and wherein the leftside and rightside cam following groove halves are offset from the cam lobe center axis.

According to another aspect of the present invention, the system further includes a plurality of split cam lobe assembly kits adapted to be installed and removed onto the camshaft, wherein each kit provides a differing cam profile offering a unique set of tuning characteristics. And, according to another aspect of the present invention, timing of the system may be one of advanced or retarded by radially clocking the split cam lobe assemblies about the camshaft.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention is a rockerless desmodromic valve and adjustable cam system 2. The present invention eliminates the use of springs and rockers normally used to close poppet valves. The present invention is designed such that it may be incorporated into modern engine designs yet to be manufactured, or it may be retrofit to existing head designs, such as used in conventional V8's, V6's, V10's, in-line 4's, inline 6's or the like. The rockerless desmodromic valve and adjustable cam system 2 may be utilized with gasoline type engines or diesel engines. Moreover, aspects of the rockerless desmodromic valve and adjustable cam system 2 may be utilized in various engine designs which uses poppet valves.

It is noted that the aforementioned conventional head 4 depicted in throughout the Figures is merely one example of a conventional head utilized on internal combustion engines. It is further appreciated that the present invention may be installed and/or retrofitted to fit on many other conventional heads 4 that have been previously manufactured or of which are currently being manufactured from numerous engine manufacturers. Additionally, it is recognized that the present invention may be integrated into specially designed heads. Thus, the scope of the invention should not be limited to the exemplary embodiment disclosed in the instant specification. Rather the exemplary embodiment of the desmodromic cam and valve system 2 should be viewed as merely one embodiment of numerous embodiments which may utilize the fundamental concepts taught and disclosed in the instant application.

Figure 1:
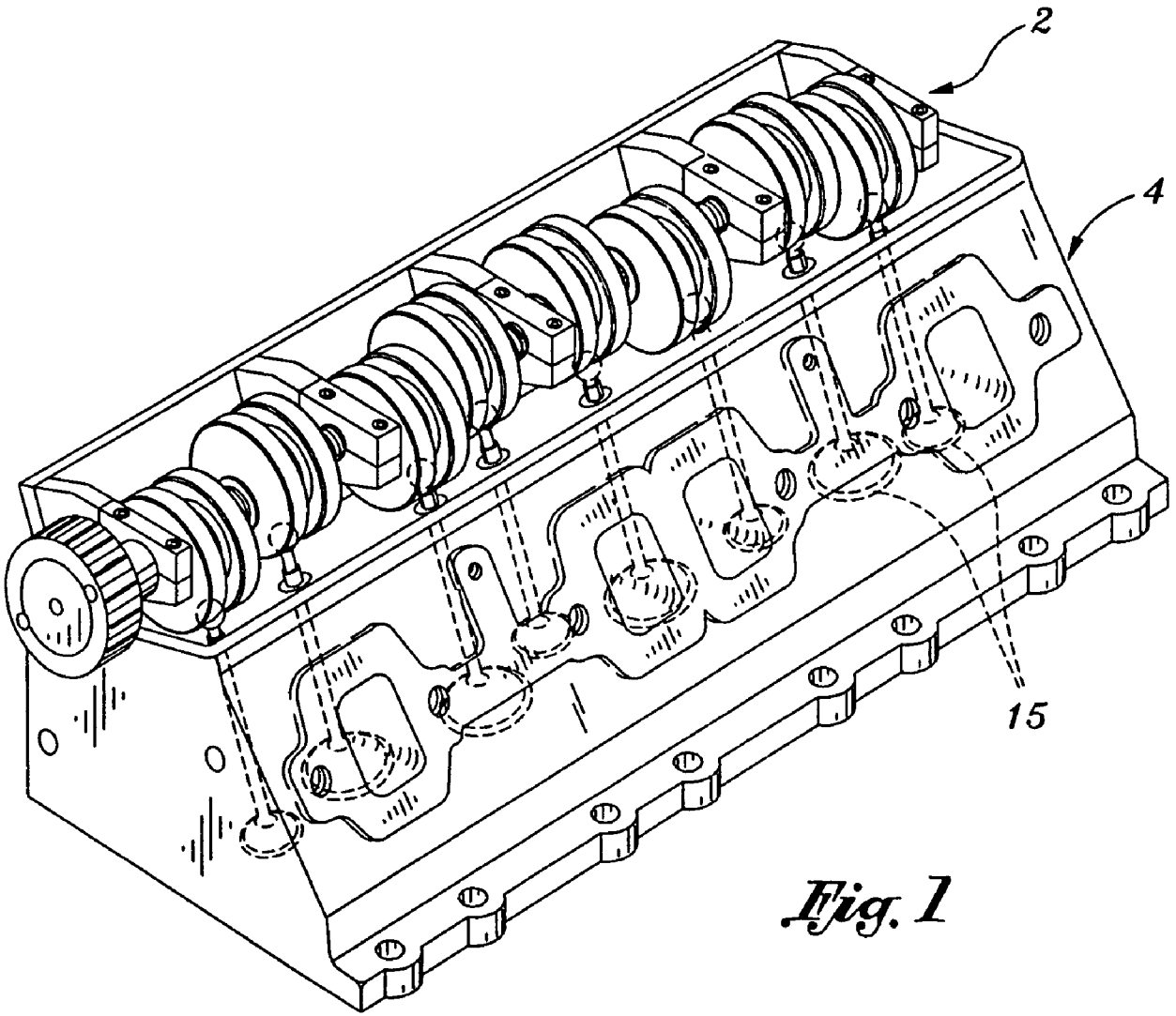
FIG. 1 shows an assembled perspective view of a desmodromic valve and adjustable cam system, according to an exemplary embodiment of the present invention.

FIG. 1 shows an assembled perspective view of a desmodromic valve and adjustable cam system 2, according to an exemplary embodiment of the present invention. The head 4 may be of any design known in the art used for typical internal combustion engines. In general, the desmodromic valve and adjustable cam system 2 is positioned in the top 8 of the head 4.

Figure 2:
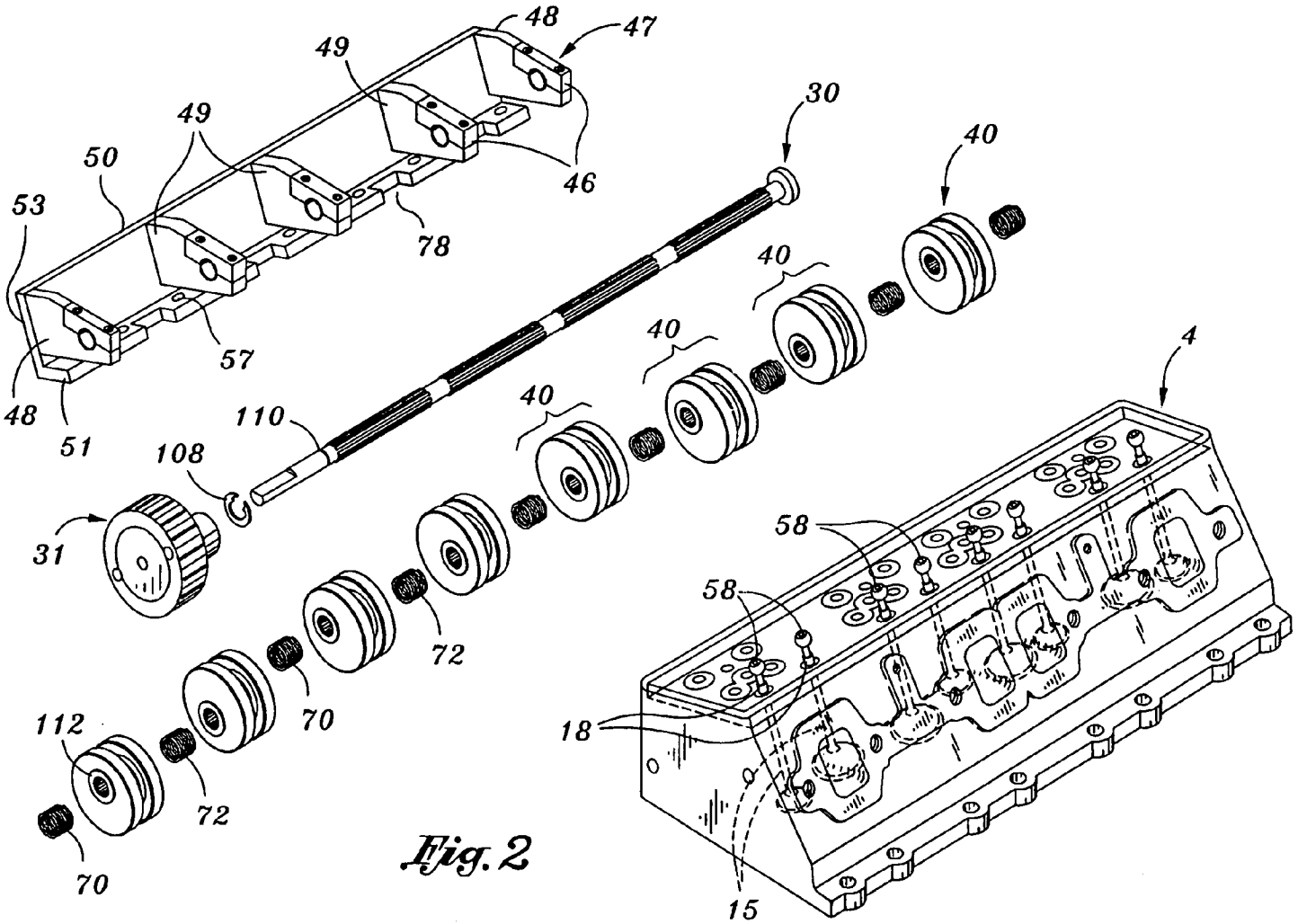
FIG. 2 shows an exploded perspective view of the desmodromic valve and adjustable cam system, according to an exemplary embodiment of the present invention.

FIG. 2 shows an exploded perspective view of the desmodromic valve and adjustable cam system 2, according to an exemplary embodiment of the present invention. The exemplary embodiment of the system 2 includes a splined camshaft 30, a cam drive 31, a plurality of splitting cam lobe assemblies 40, a camshaft bearing support bracketing system 47, plurality of concentric cam shaft springs 70, 72, and valves 15 with a retaining spheres 58 rotatably fastened to the end of the valve stem 18.

As shown in FIGS. 1–2, the camshaft 30 is positioned above the head 4 resulting in an overhead cam configuration. A camshaft 30 is used for each cylinder bank of the internal combustion engine. Thus, for example, with an in-line four cylinder engine, one camshaft 30 may be utilized. For, a conventional V-8 engine, a camshaft 30 is utilized over each head 4. Thus, the present invention may be considered an overhead cam design in the most generic sense. However, the present invention may also be utilized in dual overhead cam configurations. In such an arrangement, each head 4 would utilize a pair of camshafts 30.

Figure 3:
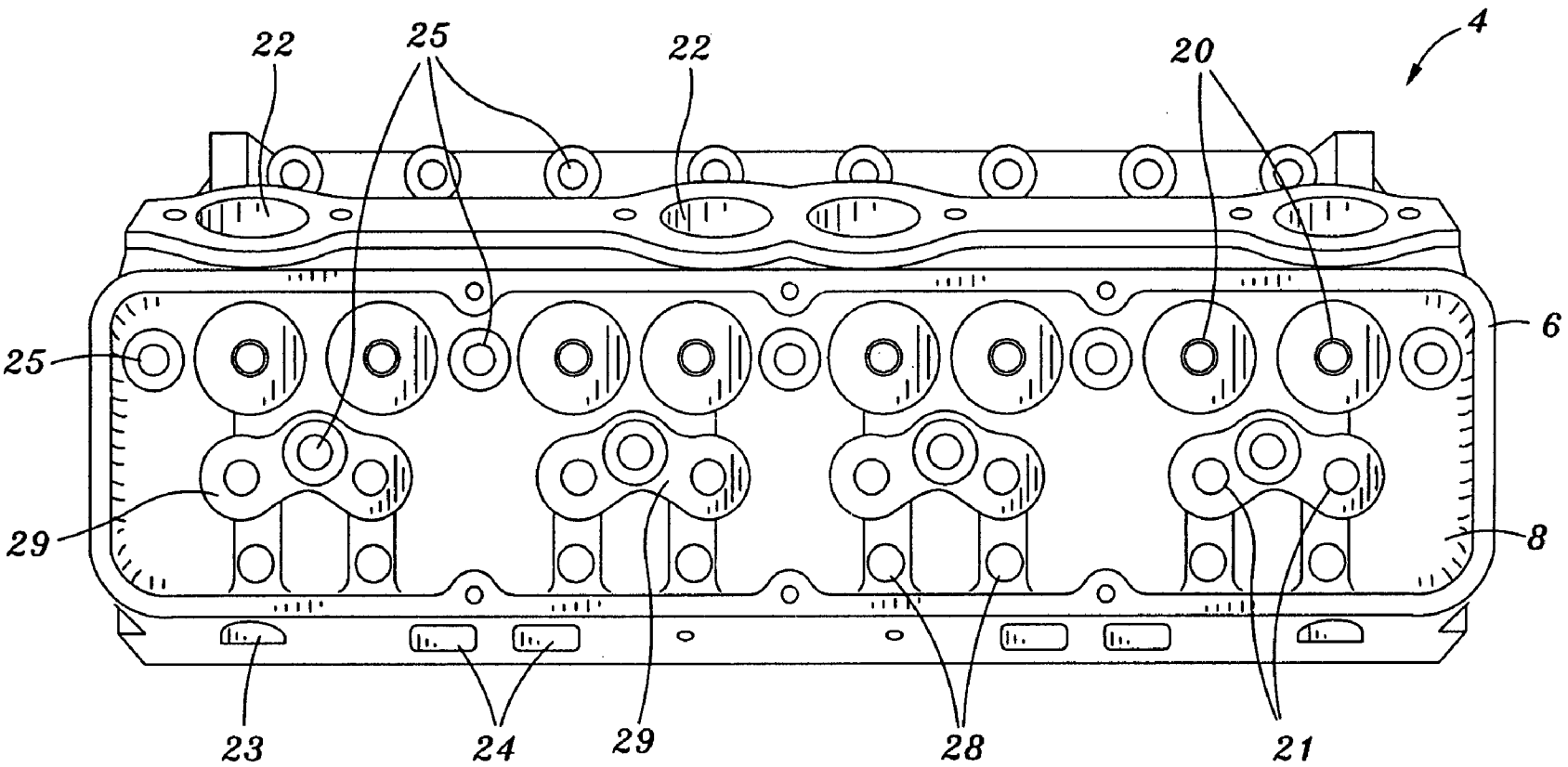
FIG. 3 shows a top view of a conventional head, according to an aspect of the present invention.

FIG. 3 shows a top view of a conventional head 4, according to an aspect of the present invention. For illustrative purposes of the present invention, the exemplary embodiment is retrofit to an existing conventional head 4. The top of the head 8 has a valve cover interface 6 which defines an upright perimeter wall structure around the entire head 4. The head 4 has a plurality of exhaust ports 22, intake ports 24, and coolant passages 23. The top of the head 8 typically has a plurality of head bolt mounting holes 25 which are used to secure the bottom of the head to the top deck of the engine block (not shown). The head 4 is disposed with a plurality of valve guides 20 which provide a passage for the valve stems 18 (not shown in FIG. 3, see FIGS. 5B–C). The head 4 further has a plurality of pushrod shafts (or holes) 28 which are not utilized with the present invention, and therefore, may be abandoned in place. Moreover, the conventional head 4 may typically have a plurality of bolt mounting holes 21 provided within a mounting surface 29 which were originally used for mounting rocker arms (not shown) to the top of the head 4. In this case, the bolt mounting holes 21 are used to secure a head mounted angle bracket 50 which is further discussed later in the specification.

Exemplary Journal Bracketing System

Figure 4:
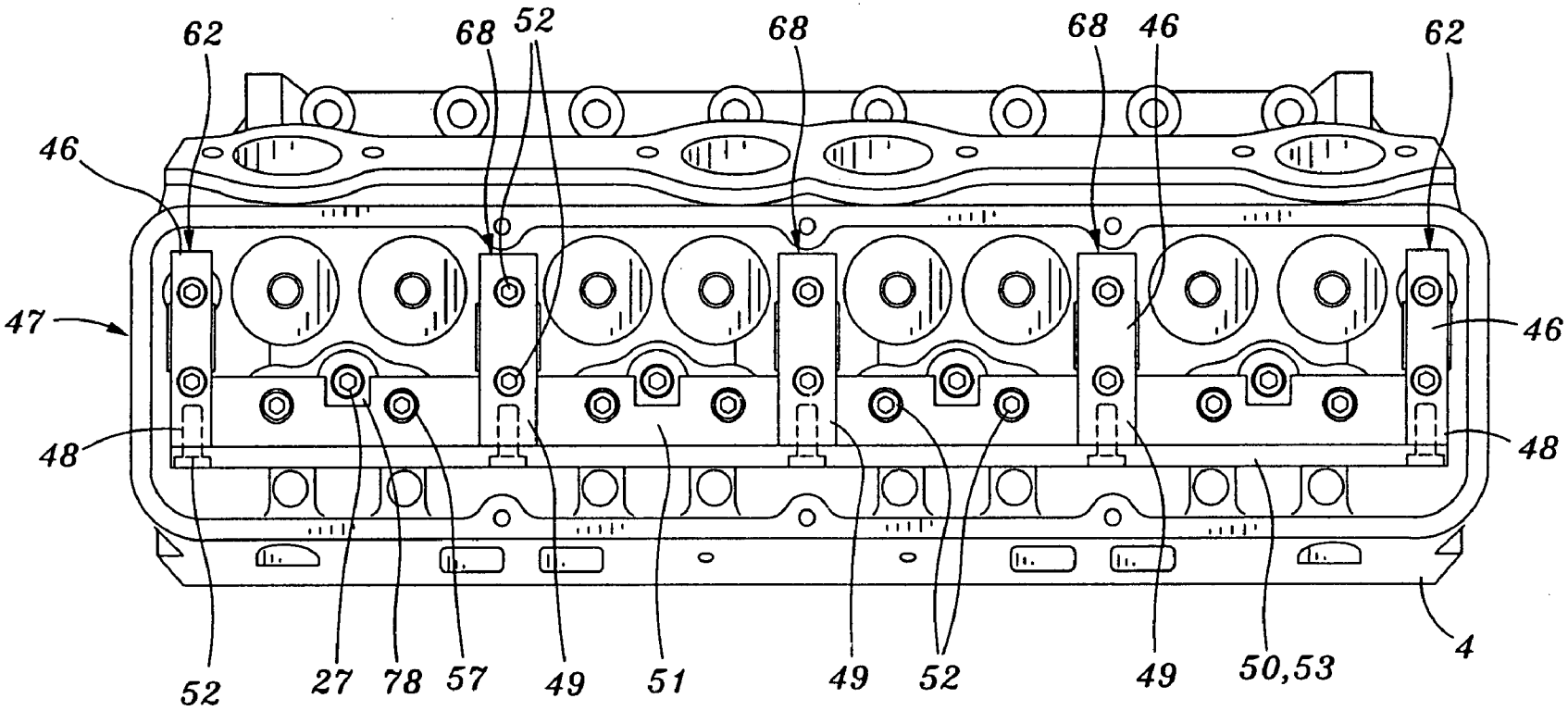
FIG. 4 shows the same top view of the head with an exemplary camshaft bearing support bracketing system installed, according to an aspect of the present invention.
Figure 5:
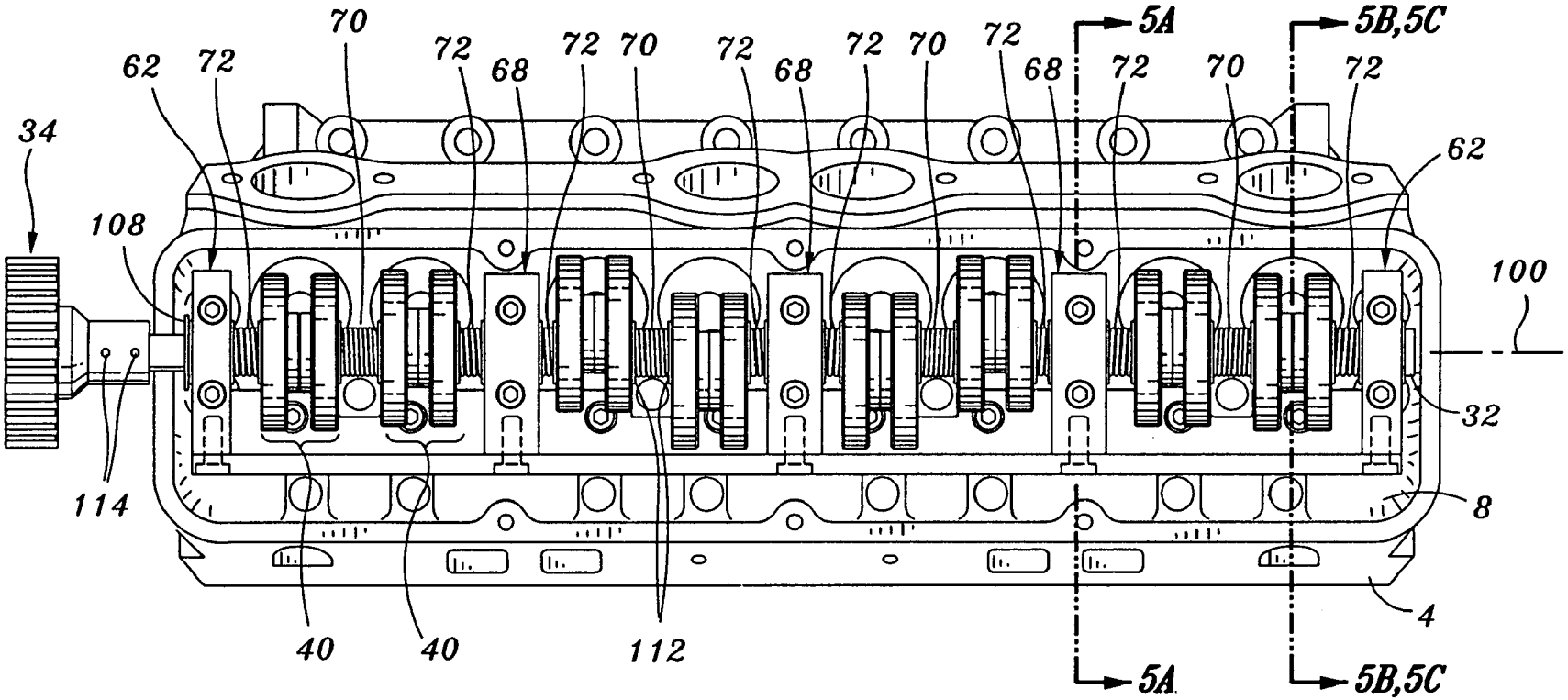
FIG. 5 shows the same top view of the head with the desmodromic valve and adjustable cam system installed, according to an aspect of the present invention.
Figure 5A:
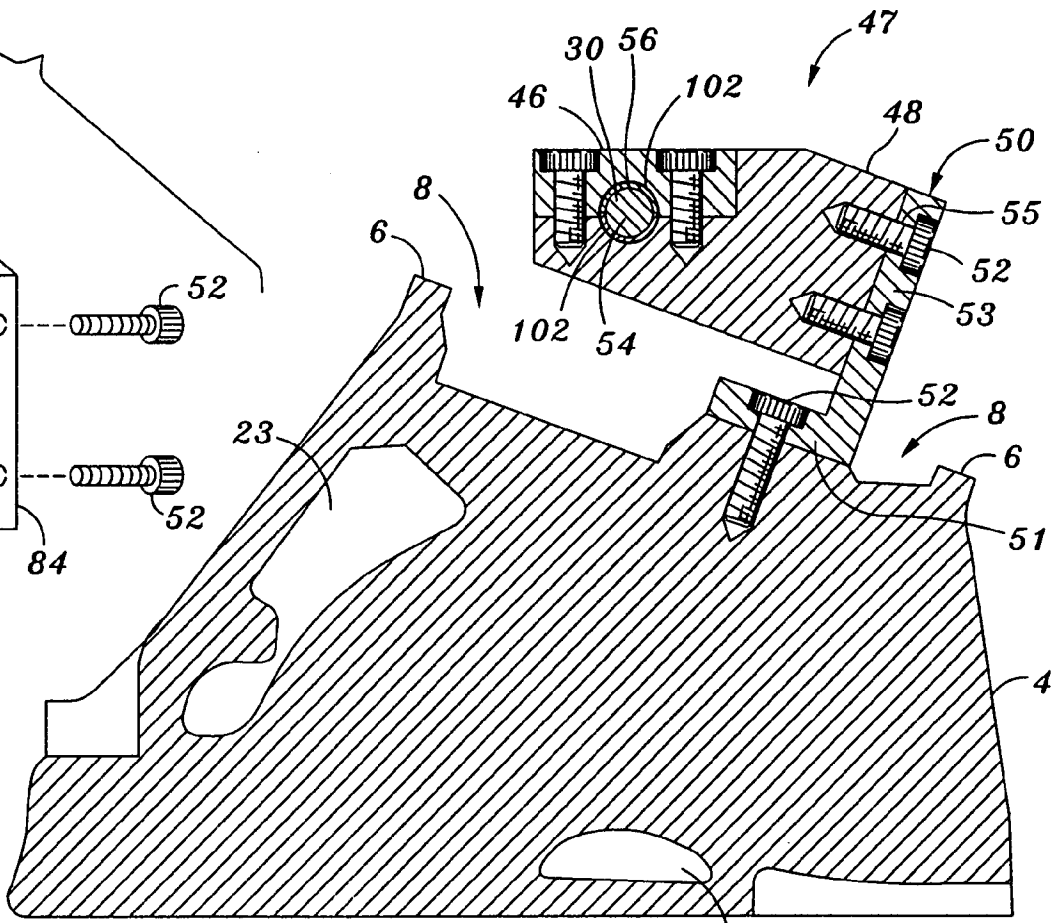
FIG. 5A shows a cross-section view of the head taken along A—A from FIG. 5, according to an aspect of the present invention.
Figure 5D:
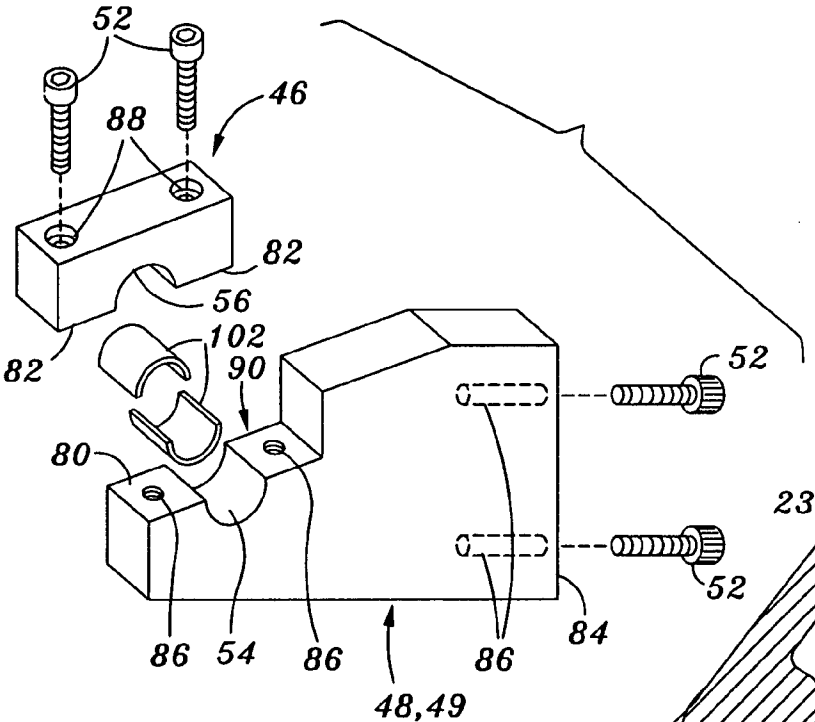
FIG. 5D shows a partial exploded perspective of an exemplary journal bearing bracket and journal cap, according to an aspect of the present invention.

As best illustrated in FIGS. 2, 4, 5A and 5D, the present invention utilizes an exemplary camshaft bearing support bracketing system 47 to provide bearing journals 54, 56 to support the camshaft 30. FIG. 4 shows an overhead perspective of an exemplary camshaft bearing support bracketing system 47 mounted to the top 8 of the head 4. FIG. 5A shows a cross-section view of the head 4 taken through a main journal 68 along section line A—A of FIG. 5, according to an aspect of the present invention. And FIG. 5D shows a partially exploded cross-section perspective an exemplary journal bearing bracket 48, 49 and journal cap 46, according to an aspect of the present invention.

The exemplary bracketing system 47 may comprise a head mounted angle bracket 50, a plurality of main journal brackets 49, and a couple of end journal brackets 48, a plurality of journal caps 46, and fastening hardware 52 (such as hex head machine thread screws). The brackets 50, 49, 48 and journal caps 46, are preferably made from light weight alloy, such as steel, aluminum, titanium or any other material utilized and suitable in engine manufacturing that is known in the art. The aforementioned hardware is utilized to provide a mounting structure to provide lower bearing journals 54 and upper bearing journals 56, such that camshaft 30 may be positioned within the bearing journals 54, 56 so that the camshaft 30 may freely rotate within the bearing journals 54, 56. It is noted that the form and shape of the angle bracket 50 and journal brackets 48, 49 may vary as long they perform the same function. Thus, it is appreciated that one of ordinary skill in the art may provide a variety of equivalent journal bracketing systems which essentially perform the same function.

In more particularity, the head mounted angle bracket 50 is oriented such that it extends along the longitudinal length of the top 8 cylinder head 4. The exemplary angle bracket 50 has a bottom portion 51 and upright portion 53. The angle bracket 50 is provided with a plurality mounting holes 57 oriented such that they match-up with existing head bolt mounting holes 21. Thus, the bottom portion 51 may be disposed with a plurality of mounting holes 57 for receiving fastening hardware 52 which are arranged in a bolt pattern dictated from the head 4. The bottom portion 51 is adapted to mount directly to the top 8 of the head 4 at mounting surfaces 29 (see FIG. 3). It is appreciated that the positioning of the mounting holes 57 may vary depending on the head 4 used in the application. In the exemplary embodiment, the bottom portion 51 may also have head bolt recesses 78 if required to provide clearance for head bolts 27 (see FIG. 4). The upright portion 53 of the bracket 50 is also disposed with journal bracket holes 55 for receiving fastening hardware 52 to mount the plurality of journal brackets 48, 49 to the upright portion 53 in a normal and vertically upright configuration.

Once the angle bracket 50 has been mounted to the top of the head 4 with fastening hardware 52, the main journal brackets 49 (three for the exemplary embodiment), and the end journal brackets 48 (one for each end of the head) are mounted to the upper portion 53 of the angle bracket 50 using fastening hardware 52. An exemplary journal bracket 48, 49 and journal cap 46 are best illustrated in FIGS. 5A and 5D. For structural soundness, the main journal brackets 49 may be thicker than the end journal brackets 48. Each journal bracket 48, 49 has a mounting surface side 84 which is adapted to be attached to the upper portion 53 of the angle bracket 50. Threaded holes 86 are provided on the mounting surface side 84 to receive fastening hardware 52. Each journal bracket 48, 49 is also provided with a rectangular shaped journal cap recess 90 adapted to receive a journal cap 46. The recess 90 includes a lower journal interface 80 having lower bearing journal 54 transversely disposed through the lower journal interface 80. Moreover, a couple of threaded holes 86 are provided to receive fastening hardware 52.

The journal cap 46 may have a rectangular shape which is adapted to be received in the journal cap recess 90. An upper journal interface 82 is disposed on the bottom of the journal cap 46. The upper journal interface 82 has an upper bearing journal 56 which is transversely disposed through the upper journal interface 82. A pair of journal cap mounting holes 88 are provided through the journal cap 46 such that fastening hardware 52 may be installed to securely fasten the journal cap 46 within the journal cap recess 90. Additionally, a pair of semi-circular bearing inserts 102 may be utilized in conjunction with the bearing journals 54, 56 to provide a durable bearing surface. The bearing inserts 102 may be made with materials well-known in the art and according to practices known in the art of bearing manufacturing.

It is further recognized that the head 4 may incorporate and provide a substantial portion of the cam shaft bearing supports. For instance, it is easily envisioned that the head 4, may be cast with structural portions transverse to the longitudinal length of the head which act of the main journals 68 and end journals 62 (see FIG. 4). In this embodiment, journal caps 46 would only have to be installed over the camshaft 30. Therefore, it is acknowledged that the aforementioned bracketing system 47 is merely one example of numerous manners that may be used to provide bearing journals 54, 56 for rotatably mounting the camshaft 30 within the head 4.

Exemplary Camshafts

Figure 6A:
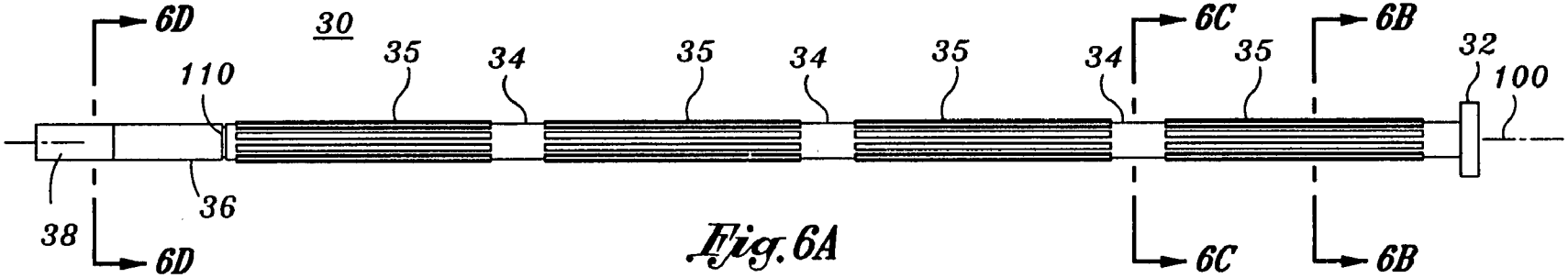
FIG. 6A shows an exemplary camshaft utilized in the system, according to an aspect of the present invention.
Figure 6D:
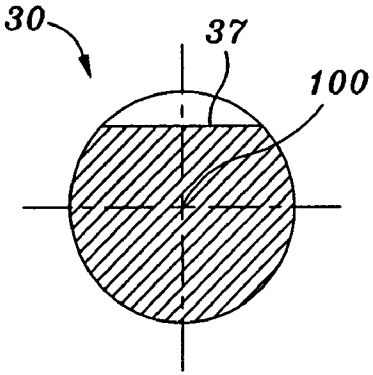
FIG. 6D shows a cross-section of the camshaft taken along 6D—6D of a cam stem portion, according to an aspect of the present invention.
Figure 6C:
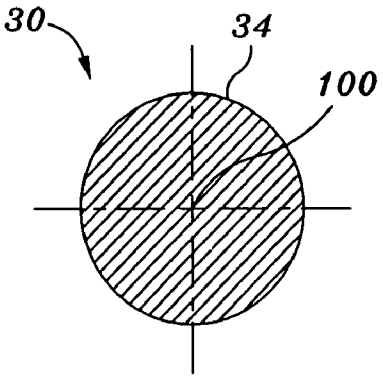
FIG. 6C shows a cross-section of the camshaft taken along 6C—6C of a bearing surface portion, according to an aspect of the present invention.
Figure 6B:
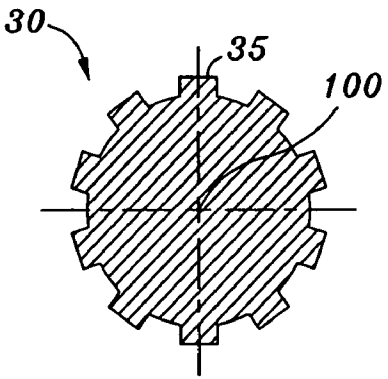
FIG. 6B shows a cross-section of the camshaft taken along 6B—6B of a splined portion, according to an aspect of the present invention.

FIGS. 6A–D shows an exemplary camshaft 30, according to an aspect of the present invention. The camshaft 30 is preferably made from a durable high-strength material known in the art, such as steel. The camshaft 30 is generally a longitudinal rod with a plurality of splined sections 35, bearing surface sections 34, 36, a cam drive stem 38, and a retaining head 32. Bearing surfaces 34 are positioned so that they are received by main journals 68 (see FIG. 4). End journal bearing surfaces 36 are positioned so they are received by end bearing journals 62. FIG. 6B shows a cross-section view of the camshaft 30 through a splined section 35 which is discussed in further detail in the following paragraph. FIG. 6C shows a cross-section view of the camshaft 30 taken through a bearing surface section 34, according to an aspect of the present invention. FIG. 6D shows a cross-section view of the camshaft 30 taken through the cam drive stem 38. A flat surface 37 is provided to receive a set screw from the cam drive 31 so that the cam drive 31 can be secured to the camshaft 30. Additionally, a snap ring receiving slot 110 is formed transversely across the camshaft 30 proximate the cam stem end 38 to receive a snap ring 108 as shown in FIGS. 2 and 5.

Figure 7A:
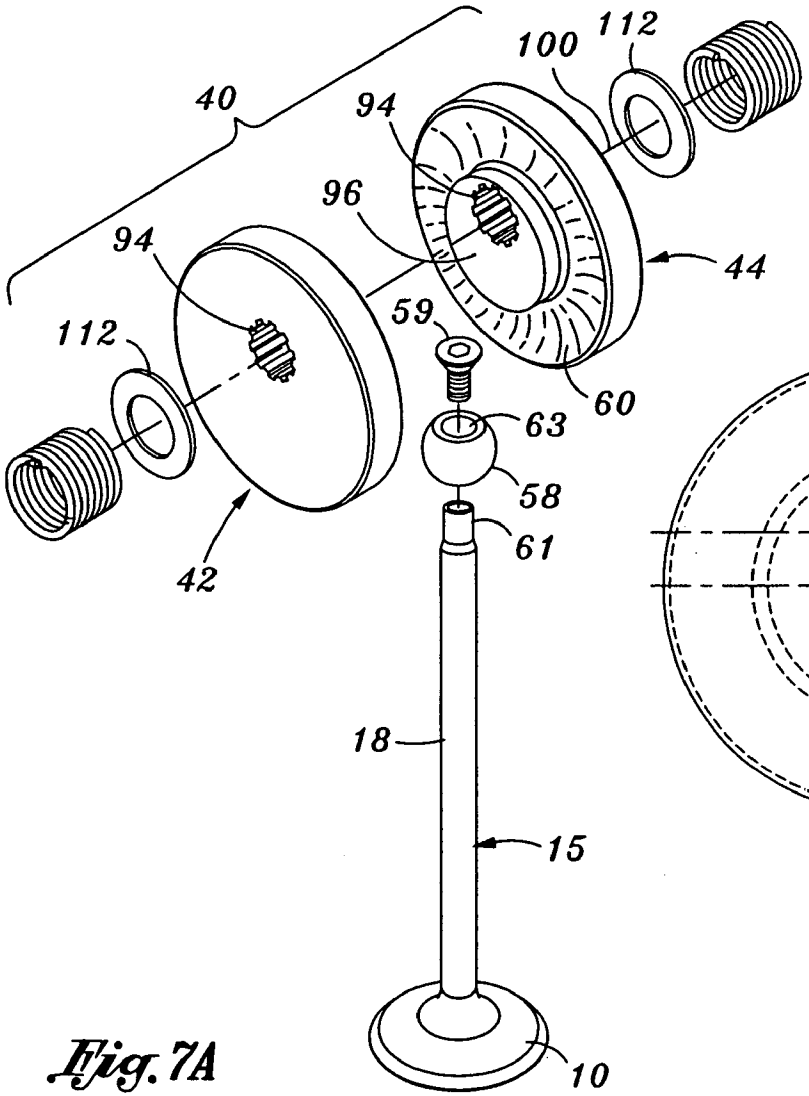
FIG. 7A shows an exploded view of a cam lobe assembly, valve, and retaining sphere, according to an aspect of the present invention.

The splines 35 are disposed/formed along the exterior surface of the camshaft 30 to provide a means to rigidly hold the cam lobe assemblies 40 radially in place, such that the cams may impart pushing and pulling forces to the valves 15, while at the same time allowing for the left cam lobe 42 and right cam lobe 44 to split apart longitudinally along the camshaft 30 (see FIGS. 7AE, 9). In other words, the splines 35 are designed for providing a slidable interface/fit between the camshaft 30 and the split cam lobe assemblies 40 in the longitudinal direction. It is noted that the shape of the splines 35 shown are merely exemplary, and, the splines 35 may have various shapes and sizes known in the art. Thus, the shape and dimensions of the splines 35 may vary according to each application. The function of the splines 35 will be discussed in further detail later in the specification.

Figure 6E:
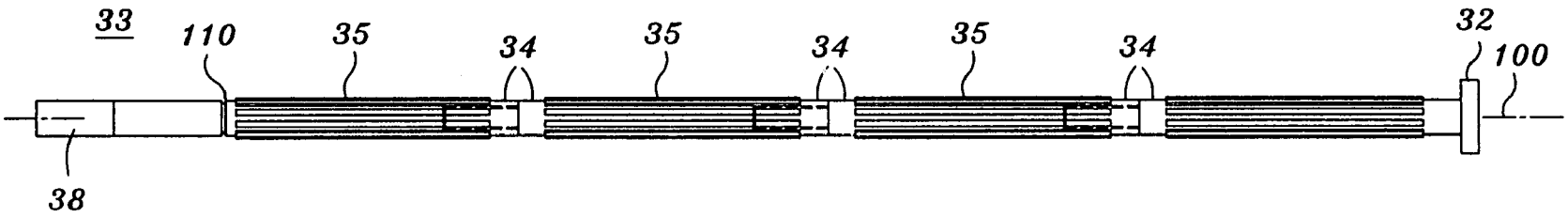
FIGS. 6E–H depicts an alternative embodiment of a camshaft which comprises a plurality of segments, according to an aspect of the present invention.
Figure 6F:
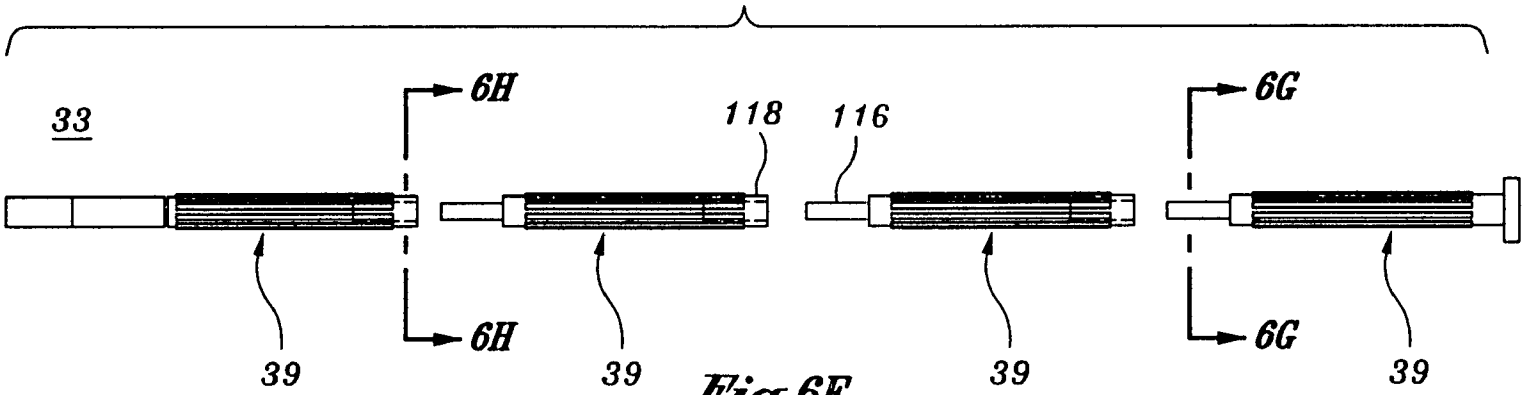
Figure 6G:
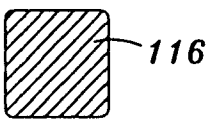
Figure 6H:
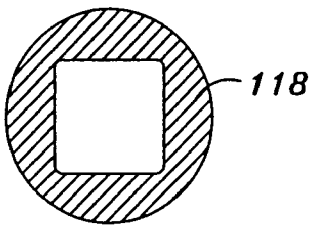

FIG. 6E depicts an exemplary alternative camshaft 33 which is similar to camshaft 30, except the alternative camshaft 33 is composed of a plurality of camshaft segments 39. The segments 39 may be connected together via a male/female interface, such as a conventional square socket system or any other interface system which provides a rigid interlock when the camshaft 33 is rotated. In more particularity, a male portion 116 may have a square cross-section as shown in FIG. 6G. A female portion 118 may provide a square tubular portion which provides a receptacle for the male portion 118 as shown in FIG. 6H.

Exemplary Split Cam Lobe Assembly

FIGS. 7A–G best illustrates an exemplary split cam lobe assembly 40 which is provided for each valve 15 in the valve train. Thus, if an engine has two valves per cylinder (i.e., an intake and exhaust valve), then there will be two split cam lobe assemblies 40 per cylinder. It is further appreciated that since engine valve trains come in a variety of configurations, that the concepts taught herein the present application may be applied to other valve train configurations. For example, the desmodromic valve and adjustable cam system 2 may also be applied to dual overhead cam systems in which each cylinder may have up to four valves per cylinder. In such an embodiment, there would be two camshafts 30 per head.

Figure 7B:
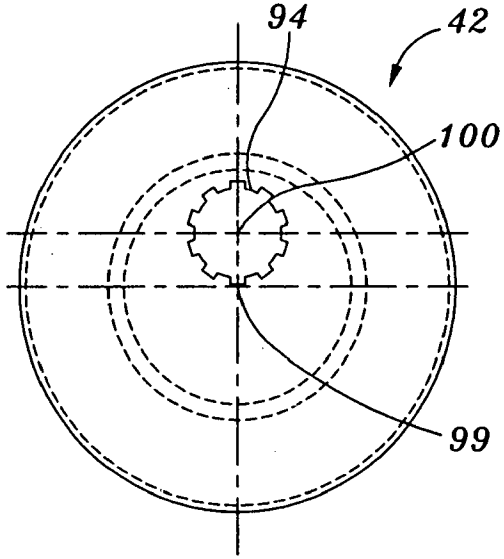
FIG. 7B shows an exterior side view of a split cam lobe, according to an aspect of the present invention.
Figure 7C:
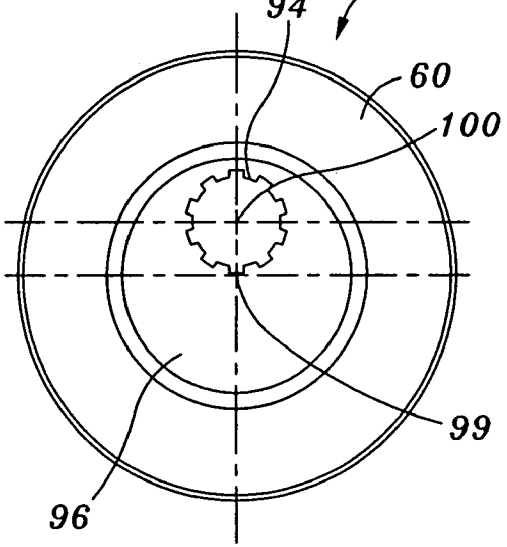
FIG. 7C shows an interior side view of the cam lobe, according to an aspect of the present invention.

FIG. 7A shows an exploded view of a cam lobe assembly 40, valve 15, and retaining sphere 58, according to an aspect of the present invention. The cam lobe assembly 40 comprises a left cam lobe 42 and a right cam lobe 44 which are similar parts. Most noticeable, the outer perimeter edge and shape of the cam lobe 42, 44 is circular and is centered about cam lobe center axis 99 (see FIGS. 7B–C). FIG. 7C shows an inside view of a cam lobe 42, 44, and FIG. 7B shows a backside view of a cam lobe 42, 44, according to an aspect of the present invention. Concentrically disposed internally within the circular cam lobe 42, 44 is a circular following groove halve 60 which is adapted to retain and slidably guide the retaining sphere 58 rotatably installed on the end of the valve stem 18. Concentrically disposed on the same side of the cam lobe 42 and centered about the cam lobe center axis 99 is a cam lobe hub 96 that is unitarily formed with to the cam lobe 42, 44. Each cam lobe 42, 44 has a splined camshaft receiving hole 94 adapted to receive a splined section 35 of the camshaft 30. The splined camshaft receiving hole 94 is centered about camshaft center axis 100 which is offset from the cam lobe center axis 99. It is noted that the tolerances between the splined camshaft receiving hole 94 and the splines 35 formed on the camshaft 30 are made such that the cam lobes 42, 44 may slide or move longitudinally along the splined section 35 of the camshaft, while simultaneously providing a sufficient locking force between the splines 35 such that the camshaft 30 may rigidly rotate the split cam lobe assembly 40 radially about the camshaft 30.

Figure 7G:
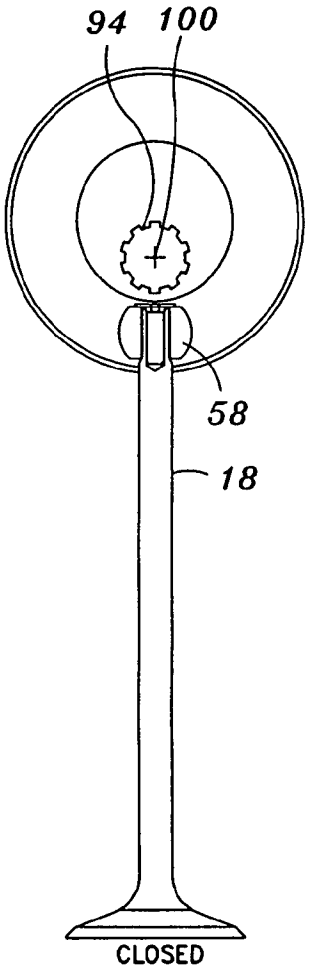
FIG. 7G shows a diagrammatic side view of the cam lobe and the valve from FIG. 7F in a fully seated state, according to an aspect of the present invention.
Figure 7F:
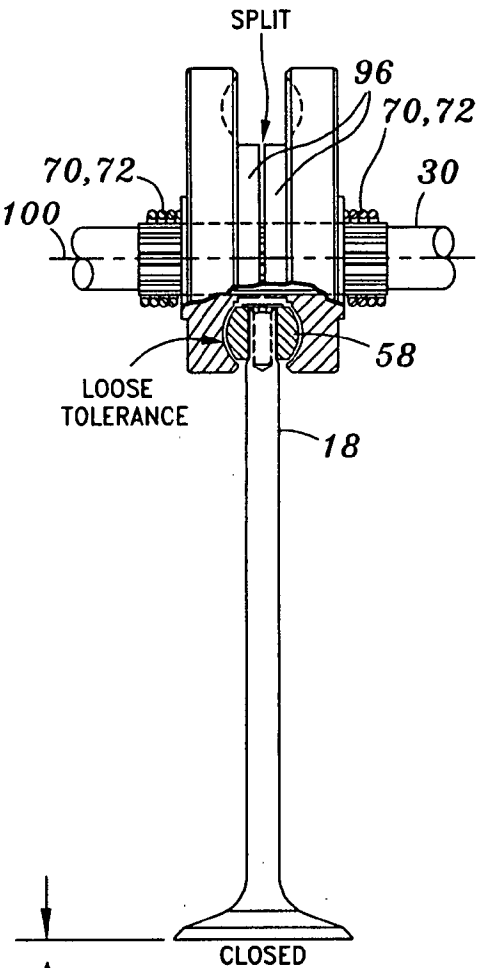
FIG. 7F shows a front view and partial cutaway of the cam lobe in a split mode assembly retaining the retaining sphere with a loose tolerance, and with the valve in a full closed position, indicating the distance A of which the valve travels upward to the exterior surface of the camshaft in relation to FIG. 7E, according to an aspect of the present invention.
Figure 7E:
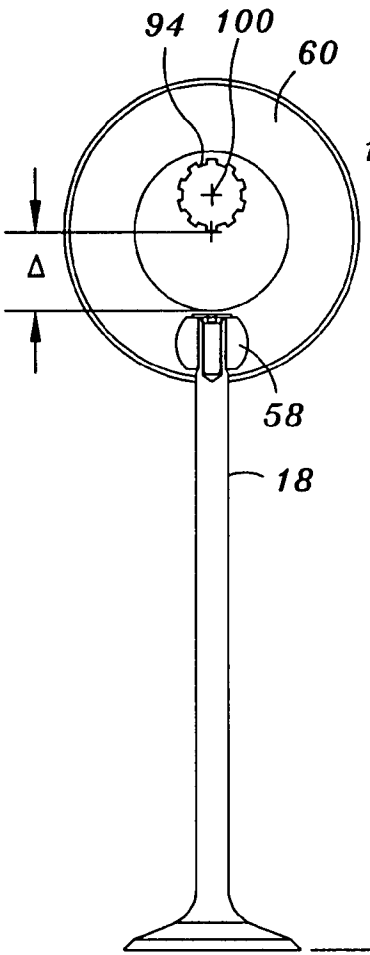
FIG. 7E shows a diagrammatic side view of the cam lobe and valve from FIG. 7D indicating the distance A of which the valve travels in a stroke, according to an aspect of the present invention.
Figure 7D:
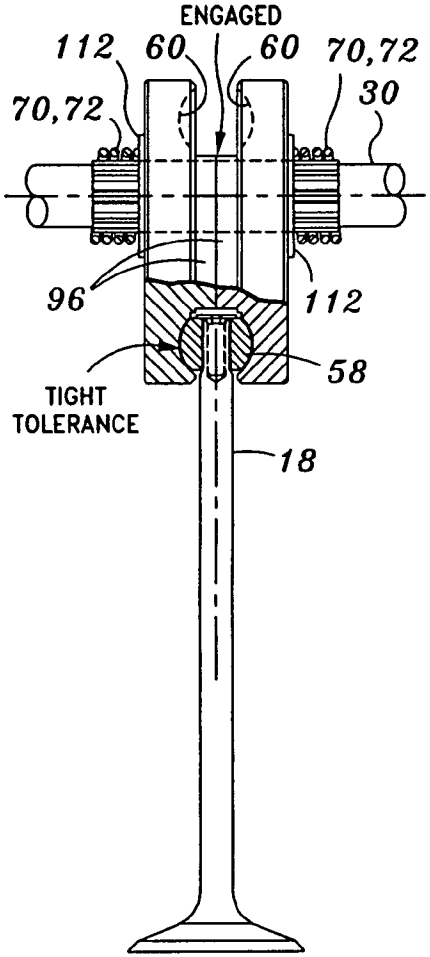
FIG. 7D shows a front view and partial cutaway of the cam lobe assembly in a engaged closed mode retaining the retaining sphere with a tight tolerance, and with the valve in a full opened position, according to an aspect of the present invention.

The splitting feature of the cam lobe assembly 40 and the movement of the valve relative to an open and closed position is illustrated in FIGS. 5B–C, 7D–G, and 9. In particular, FIG. 7D shows a cross-section view of the cam lobe assembly 40 taken when the cam lobe assembly 40 is fully compressed together by springs 70, 72 and fully engaged to the retaining sphere 58, according to an aspect of the present invention. To move the valve 15 open and closed, the crankshaft 30 is rotated, which imparts rotational movement to the cam lobe assembly 40. In a substantial majority of the valve opening/closing cycle, the cam lobe assembly 40 maintains the fully engaged position in which the cam lobe hubs 96 are compressed and interfaced together. As a result a tight, but slidable tolerance, is produced around the retaining sphere 58.

Figure 5B:
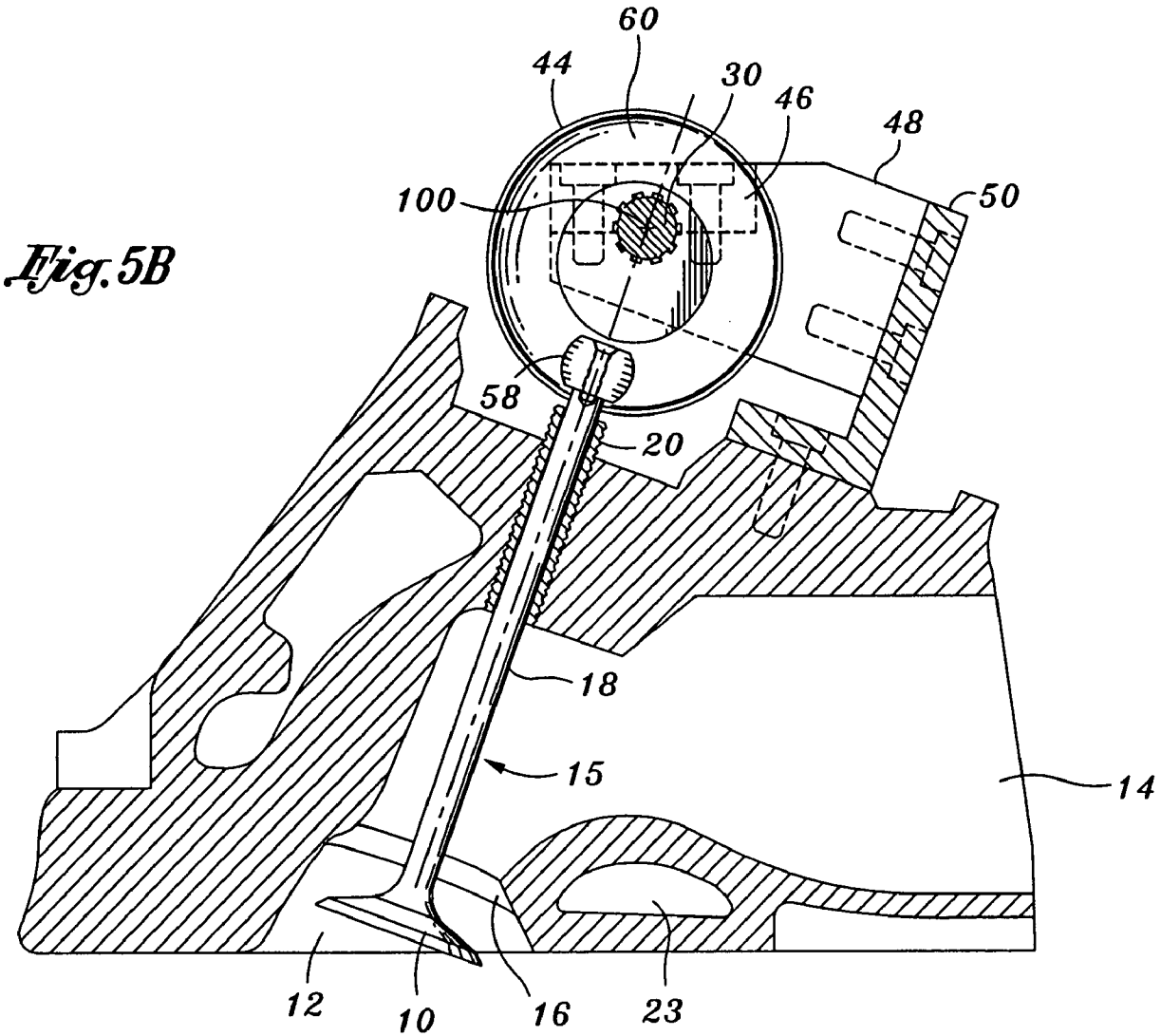
FIG. 5B shows a cross-section view of the head with an open valve taken along B—B from FIG. 5, according to an aspect of the present invention.
Figure 5C:
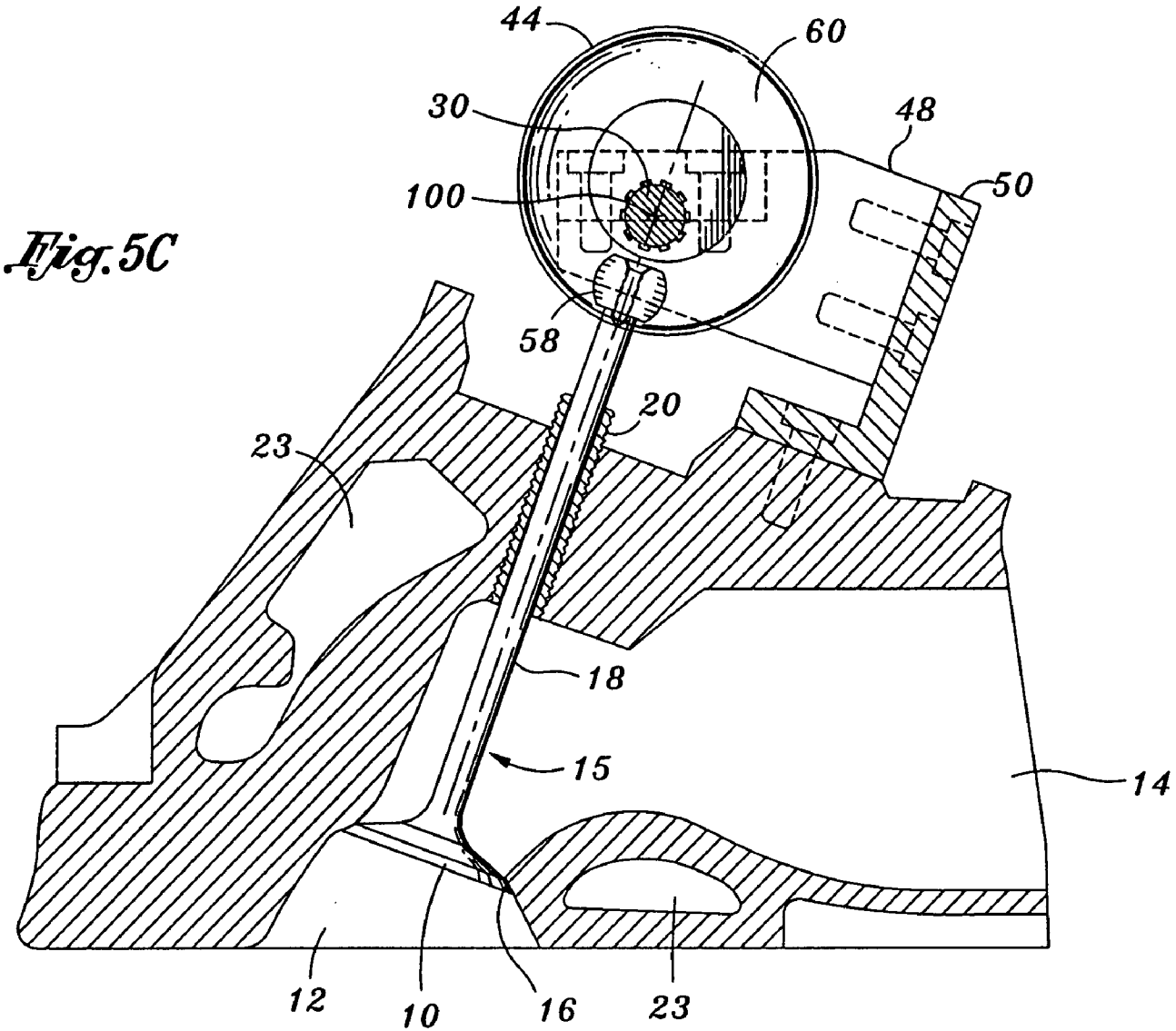
FIG. 5C shows a cross-section view of the head with a closed valve taken along B—B, according to an aspect of the present invention.

FIG. 5B shows a cross-section view taken along B—B of FIG. 5 of the head 4 with the valve 15 in an opened position, according to an aspect of the present invention; while FIG. 5C shows a cross-section view taken along B—B of FIG. 5 of the head 4 with the valve 15 in a closed position, according to an aspect of the present invention. Additionally, FIG. 7E shows a diagrammatic side view of the cam lobe 42, 44 and valve 15 from FIG. 7E indicating the distance A of which the valve 15 travels in a stroke as compared to the closed position shown in FIG. 7F, according to an aspect of the present invention. Also, FIG. 7G shows a diagrammatic side view of the cam lobe 42, 44 and valve 15 from FIG. 7F in the fully closed position, according to an aspect of the present invention.

In more particularity, FIG. 7F shows a front view and partial cutaway of the cam lobe assembly 40 in a split mode retaining the retaining sphere 58 with a loose tolerance, and with the valve 15 in a fully seated and closed position, indicating the distance A of which the valve travels upward to the exterior surface of the camshaft in relation to FIG. 7E, according to an aspect of the present invention. The cam lobe assembly 40 is designed to be able split open when the valve head 10 is excessively pulled against the valve seat 16. This split feature is provided to prevent damage that may occur to the valves 15 which may result from the valve head 10 being pulled upward excessively and overforced into the valve seat 16.

An Exemplary Desmodromic Valve and Adjustable Cam System Installed Into a Head

FIGS. 1, 5, 5B–C and 9 show the exemplary desmodromic valve and adjustable cam system 2 installed into the head 4, according to an aspect of the present invention. As best shown in FIG. 5, the camshaft bearing support bracketing system 47 provides several main journal structures 68 and a pair of end journals 62. The cam retaining head 32 is positioned on the outside of one end journal to prevent the crankshaft 30 from moving longitudinally along the camshaft center axis 100. Additionally, a snap ring 108 is installed into the snap ring receiving slot 110 (as shown in FIGS. 2 and 5) to further prevent the crankshaft 30 from moving longitudinally along the camshaft center axis 100. FIGS. 1 and 5 show the cam drive 31 attached to the drive stem 38 of the camshaft 30. The cam drive includes set screws 114 which are tightened against the flat surface of 37 of the drive stem 38.

Still referring to FIG. 5, it is further shown how a plurality of cam-to-cam concentric coil springs 70, cam-to-journal concentric coil springs 72, and split cam assemblies 40 are installed onto the crankshaft 30. It is noted that the cam-to-journal concentric coil springs 72 are used between the journals 62 or 68 and the cam lobes 42, 44, while the cam-to-cam concentric coil springs 70 are used between the two exterior sides of the cam lobes 42, 44. Also, optionally, washers 112 may be positioned between the exterior face of the cam lobe 42, 44 to provide a slidable interface between the exterior side of the cam lobe and the end of the spring 42, 44 to minimize wear on the springs 70, 72 and exterior side of the cam lobes 42, 44.

The following paragraph will now further describe cam-to-cam springs 70 and cam-to-journal springs 72. The cam-to-cam springs 70 and cam-to-journal springs 72 should apply sufficient force against the exterior sides of the cam lobes 42, 44 such that the retaining sphere 58 attached the distal end of the valve stem 18 is securely retained within the cam following grooves 60. However, the springs 70, 72 should be able to slightly compress when the valve head 10 is excessively forced into the valve seat 16. Preferably the springs 70, 72 are closed end coils squared by grinding (i.e. "squared and ground") such that they may abut against the exterior sides of the cam lobes without damaging the cam lobe 30. And as discussed above, in the alternative, washers 112 may be positioned between the spring end and the exterior surface of the cam lobes 42, 44. It is acknowledged that spring design characteristics for the cam-to-cam springs 70 and cam-to-journal springs 72 may vary depending on the applications, however, it is recognized that one of ordinary skill in the art may test various springs to determine appropriate parameters such as load, deflection, diameter of spring wire, Wahl factor, pitch, spring constant, number of active coils, overall free length, solid overall length, etc. to accomplished the desired functional attributes as discussed above.

Adjustability and Cam Tuning Features; Alternative Cam Lobes

Another one of the aspects of the present invention is that the cam lobe assemblies 40 may have varying profiles (or "grinds"), therefore, allowing one to determine how rapidly or quickly the valve 15 is opened and closed, and the duration (i.e., the length that the valve 15 is held open by the cams 42, 44). And since the present invention 2 is designed such that the cam assemblies 40 may be removed and replaced, this allows one to install cam assemblies 40 with varying following groove 60 shapes for tuning purposes.

Moreover, another aspect of the present invention is that the cam lobe assemblies 40 may being radially "clocked" around the cam shaft 30 to either advance the timing or to retard the timing. Since the split cam assemblies 40 are attached to the camshaft 30 by mating the splined camshaft receiving hole 94 to the splined sections 30, an adjustability factor is inherently built into the system 2. That is to say, the split cam assemblies 40 may be clocked in any position around the camshaft 30 as long as the valve timing is still functional.

FIGS. 8A–I show a diagrammatic side view of alternative cam lobes 33 with various profiles which illustrate various following grooves for adjusting duration, including normal timing modes, advanced timing modes, and retarded timing modes, according to an aspect of the present invention.

Instead of locating the splined camshaft receiving hole 94 about the camshaft 30 in an offset manner such as is taught with the first embodiment of the left and right cam lobes 42, 44 (see FIGS. 7B–C), the alternative cam lobes 33 have splined camshaft receiving holes 94 which are centered about the cam lobe center axis 99. Furthermore, the following groove 60 is offset from the cam lobe center axis 99, instead of being concentric about the cam lobe body as in the first embodiment.

Figures 8A, 8B, 8C, 8D, 8E, 8F:
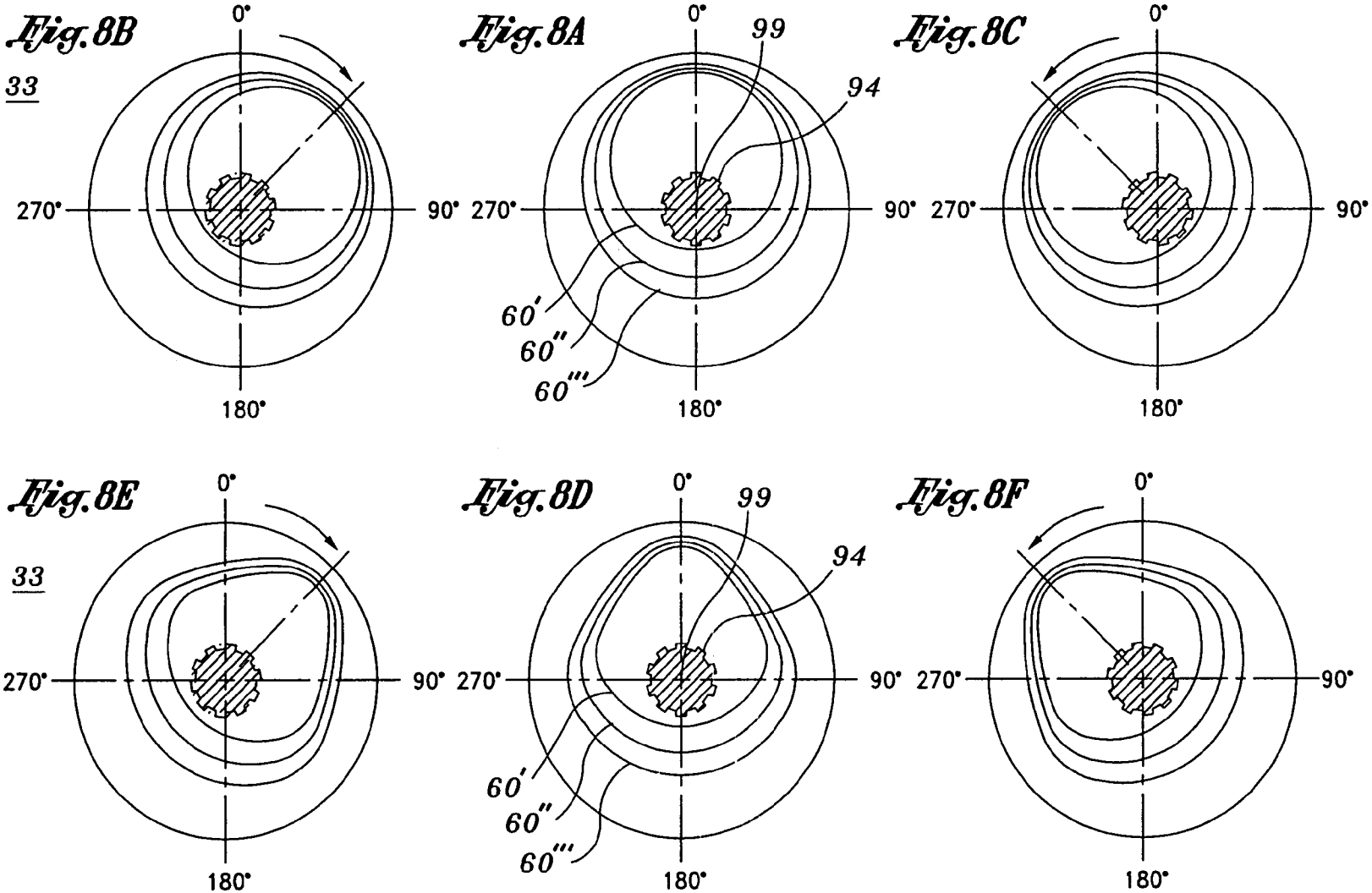
FIGS. 8A–I show a diagrammatic side view of alternative cam lobes with various profiles which illustrate numerous following grooves for adjusting duration, including normal timing modes, advanced timing modes, and retarded timing modes, according to an aspect of the present invention.
Figures 8G, 8H, 8I:
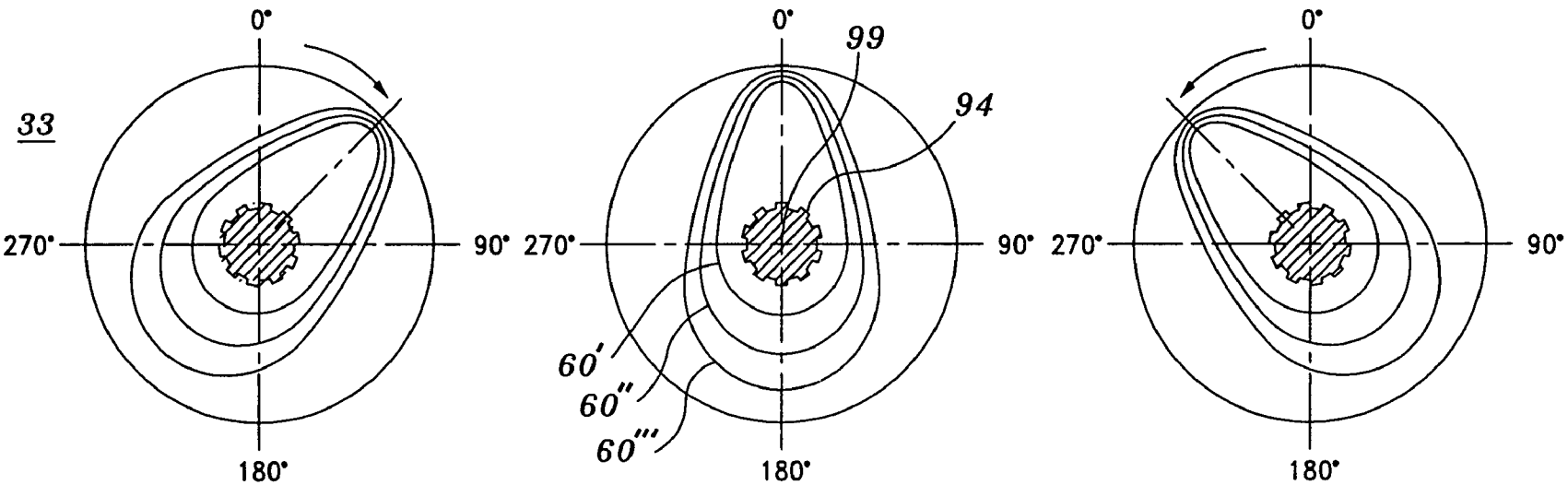
Figure 9:
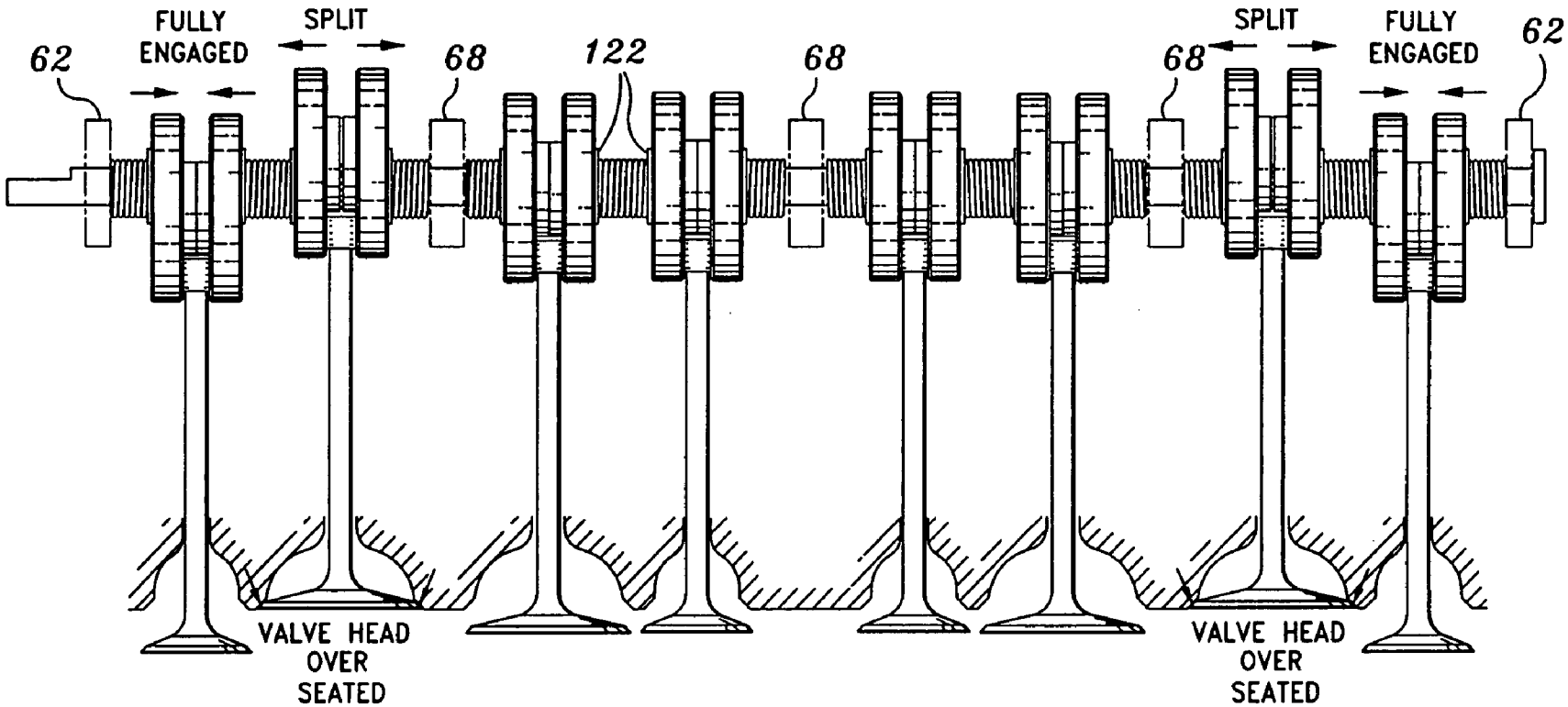
FIG. 9 shows a side view of an assembled valve train, including the split cam assemblies connected to the retaining spheres, and the positioning of the valves, according to an aspect of the present invention.

Moreover, FIGS. 8A, 8D, 8G show how differently sized and shaped cam grooves with shapes 60', 60", 60''' can provide various profiles and durations which allow the performance of the engine to be tuned (e.g., conservatively or aggressively). Additionally, the same cam lobes 37 may be advanced as shown in FIGS. 8B, 8E, and 8H, and retarded as shown in FIGS. 8C, 8E, and 8I.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and such uses are within the scope of the appended claims.

What is claimed is:

1. A rockerless desmodromic valve and adjustable overhead cam system adapted to be installed onto a head for an internal combustion engine which utilizes at least one poppet valve for each intake and exhaust port, said system comprising:

a plurality of valves having a retaining sphere disposed on a distal tip of a stem of each valve;

a camshaft adapted to be transversely positioned within a plurality of bearing journals transversely positioned and spaced along a longitudinal length of the head;

a split cam lobe assembly assigned to each valve comprising, a left cam lobe having an exterior side, interior side, a camshaft receiving hole oriented transversely through said left cam lobe adapted to slidably receive said camshaft, and a leftside cam following groove halve disposed on said interior side, and a right cam lobe having an exterior side, interior side, a camshaft receiving hole oriented transversely through said right cam lobe adapted to slidably receive said camshaft, and a rightside cam following groove halve disposed on said interior side;

wherein said interior sides of said left and right cam lobe are adapted to be interfaced together to form a following groove having a generally spherical cross-sectional shape adapted to slidably receive said retaining sphere from a respective one of said valves.

2. The desmodromic valve and adjustable overhead cam system according to claim 1, further comprising a plurality of springs concentrically disposed around said camshaft and further longitudinally positioned between cam lobe assemblies and said bearing journals, wherein said plurality of springs maintain a constant force against said exterior sides of said cam lobes to maintain said split lobe cam assemblies compressed together.

3. The desmodromic valve and adjustable overhead cam system according to claim 2, wherein when a head of a valve is overforced into a valve seat, a respective cam lobe assembly connected to a respective retaining sphere on a respective valve, slightly splits open to provide a slidable fitting having a relaxed tolerance between the following groove and said respective retaining sphere to minimize valve train binding.

4. The desmodromic valve and adjustable overhead cam system according to claim 3, wherein when said head of said valve is lowered from the valve seat, said respective cam lobe assembly connected to said respective retaining sphere on said respective valve is forced back into an unsplit mode by springs.

5. The desmodromic valve and adjustable overhead cam system according to claim 1, said camshaft further comprising a plurality of bearing surfaces on an exterior surface of said camshaft adapted to be received by said bearing journals, and a plurality of sections of splines disposed on said exterior surface of said camshaft for slidably receiving said cam lobe assemblies.

6. The desmodromic valve and adjustable overhead cam system according to claim 1, said camshaft further comprising a retaining head disposed on one distal end of said camshaft, and a cam drive stem disposed on another distal end of said camshaft for receiving a cam drive.

7. The desmodromic valve and adjustable overhead cam system according to claim 1, said camshaft comprising camshaft segments, each camshaft segment adapted to be longitudinally attached together to form an assembled camshaft.

8. The desmodromic valve and adjustable overhead cam system according to claim 6, further comprising a cam drive attached to said cam drive stem.

9. The desmodromic valve and adjustable overhead cam system according to claim 1, each of said plurality of valves comprising a sphere receiving shaft formed on said distal tip of said stem of each valve, wherein a threaded hole is disposed within said sphere receiving shaft, the threaded hole adapted to receive a threaded fastener to secure said retaining sphere to a respective valve stem.

10. The desmodromic valve and adjustable overhead cam system according to claim 1, said retaining sphere comprising a spherical body having a shaft hole disposed through said spherical body, wherein the shaft hole is adapted to receive a sphere receiving shaft formed on said distal tip of said stem of said valve.

11. The desmodromic valve and adjustable overhead cam system according to claim 1, further comprising a camshaft bearing support bracketing system which provides said bearing journals.

12. The desmodromic valve and adjustable overhead cam system according to claim 11, said camshaft bearing support bracketing system comprising, a bottom portion adapted to be mounted to a top surface of the head, and an upright portion integrally formed with said bottom portion; and a plurality of journal bearing brackets attached in a normal and vertically upright orientation to an inside surface of said upright portion.

13. The desmodromic valve and adjustable overhead cam system according to claim 12, each of said plurality of journal brackets further comprising a lower journal interface surface having a lower bearing journal transversely formed through said lower journal interface; and a journal cap adapted to be interfaced to said lower journal interface, said journal cap including an upper journal interface surface having an upper bearing journal transversely formed through said upper journal interface surface;

wherein a cylindrical bearing interface is formed when said journal cap is attached to a respective one said plurality of journal brackets.

14. The desmodromic valve and adjustable overhead cam system according to claim 13, further comprising a pair of semicircular bearing inserts installed into said upper and lower bearing journal interface.

15. The desmodromic valve and adjustable overhead cam system according to claim 2, said left and right cam lobes further comprising a hub integrally formed to said interior side of said cam lobe, wherein said hub from said left and right cam lobes are adapted to be compressed together by said springs.

16. The desmodromic valve and adjustable overhead cam system according to claim 5, said left and right camshaft receiving holes including a splined camshaft receiving hole adapted to be received by said splined sections of said camshaft.

17. The desmodromic valve and adjustable overhead cam system according to claim 1, said right and left cam lobes having a cam lobe center axis transversely oriented through a center of said cam lobe.

18. The desmodromic valve and adjustable overhead cam system according to claim 17, said right and left cam lobes including a camshaft receiving hole centered about a camshaft center axis, the camshaft center axis being radially offset from the cam lobe center axis.

19. The desmodromic valve and adjustable overhead cam system according to claim 18, wherein said leftside and rightside cam following groove halves are concentrically centered about the cam lobe center axis.

20. The desmodromic valve and adjustable overhead cam system according to claim 17, said right and left cam lobes including a camshaft receiving hole centered about a camshaft center axis, wherein the camshaft center axis is coincident with the cam lobe center axis.

21. The desmodromic valve and adjustable overhead cam system according to claim 20, wherein said leftside and rightside cam following groove halves are offset from the cam lobe center axis.

22. The desmodromic valve and adjustable overhead cam system according to claim 1, further comprising a plurality of split cam lobe assembly kits adapted to be installed and removed onto said camshaft, wherein each kit provides a differing cam profile offering a unique set of tuning characteristics.

23. The desmodromic valve and adjustable overhead cam system according to claim 1, wherein timing of said system may be one of advanced or retarded by radially clocking said split cam lobe assemblies about said camshaft.

* * * * *